US005286241A

United States Patent [19]

Petrakis

[11] Patent Number: 5,286,241

[45] Date of Patent: Feb. 15, 1994

[54] TETHERED PUNCHING BAG SUPPORT DEVICE

[76] Inventor: Perry G. Petrakis, 131 Hewitt St., Trenton, N.J. 08611

[21] Appl. No.: 979,928

[22] Filed: Nov. 23, 1992

[51] Int. Cl.[5] ..... A63B 69/22

[52] U.S. Cl. ..... 482/87; 482/83; 482/908

[58] Field of Search ..... 482/87, 89, 36, 90, 482/88, 92, 23, 33, 39, 83-86, 148, 908, 904; 108/7; 273/181 R, 55 A, 184 R, 181.12, 185 C

[56] References Cited

U.S. PATENT DOCUMENTS

| | | | |
|---|---|---|---|
| 124,588 | 3/1872 | Kehoe . | |
| 647,487 | 4/1900 | Frazier | 482/87 |
| 694,664 | 3/1902 | Rastetter | 482/87 |
| 732,740 | 7/1903 | Hansen | 482/90 |
| 774,184 | 11/1904 | Keith | 482/87 |
| 780,784 | 1/1905 | Davis | 482/87 |
| 818,604 | 4/1906 | Bierd . | |
| 992,868 | 5/1911 | Gorman | 482/8 |
| 1,050,501 | 1/1913 | Walter . | |
| 1,851,649 | 3/1932 | Schindler . | |
| 1,928,089 | 9/1933 | Blickman | 482/90 |
| 2,625,356 | 1/1953 | Kennedy et al. . | |
| 3,226,116 | 12/1965 | Klinger . | |
| 3,411,497 | 1/1968 | Rickey et al. | 482/87 |
| 3,542,364 | 11/1970 | Gaumond . | |
| 3,776,551 | 12/1973 | Schalter . | |
| 3,785,643 | 1/1974 | Rich . | |
| 4,257,589 | 3/1981 | Outlaw . | |
| 4,522,394 | 6/1985 | Broussard | 482/90 |

FOREIGN PATENT DOCUMENTS

| | | | |
|---|---|---|---|
| 0461281 | 6/1928 | Fed. Rep. of Germany | 482/86 |

*Primary Examiner*—Richard J. Apley
*Assistant Examiner*—Jerome Donnelly
*Attorney, Agent, or Firm*—Abdallah & Muckelroy

[57] ABSTRACT

A punching bag support device including a lower frame assembly, an upper frame assembly, a height adjustment pole assembly selectively attachable at an upper end to the upper frame assembly and at a lower end to the lower frame assembly, a punching bag support platform selectively and adjustably attachable to the upper frame assembly and a cross bar selectively attachable to the lower frame assembly or the height adjustment pole assembly.

12 Claims, 4 Drawing Sheets

TETHERED PUNCHING BAG SUPPORT DEVICE

BACKGROUND OF THE INVENTION

The present invention generally relates to boxing training devices. More specifically, this invention relates to support means for tethered punching bag training devices.

Various support means for punching bag training devices are disclosed in the prior art which provide for free swinging and turning of a punching bag and/or vertical adjustment of a punching bag. Such devices facilitate the training of a boxer in the different punches of the sport. Vertically adjustable punching bags are also adaptable for the training of boxers of different heights. In U.S. Pat. No. 818,604 to Bierd a punching bag support is disclosed which comprises a bag supporting hanger threadedly attached to a bearing ring, said bearing ring being rotatably engageable with a support bracket that is fixedly attachable to a ceiling or other like surface. The bag supporting hanger is constructed in a manner to permit the suspension of a punching bag therefrom by a rope or rod. A similar punching bag support is described in U.S. Pat. No. 1,050,501 to Walter which reduces wear on the suspended rope as it swings back and forth by securing one end of the support rope to a hollow ball seated within a tubular member. Vacuum cup punching bag mounting means are described in U.S Pat. No. 3,226,116 to Klingler. While these punching bag support means of the prior art permit pendulum rotation and axial turning of a punching bag, they are not adaptable for the training of boxers of different height or for training for opponents of varying height. Furthermore, training on punching bags so supported is generally limited to speed training due to the rapid pendulum movements of the bag.

Vertically adjustable punching bag supports and boxing training devices that permit striking of a bag from different positions are also known in the prior art. In U.S. Pat. No. 1,851,649 to Schindler an adjustable punching bag is disclosed having a bag suspended from an elastic cord that is attached to a vertically adjustable support line by means of a slidably mounted carrier device. The support line is detachably securable at its ends to a wall or like surface and includes stops selectively disposed upon said support line to limit the lateral movement of said carrier device along said support line. In U.S. Pat. No. 2,625,356 to Kennedy et al. there is disclosed an adjustable punching bag training device comprising, in combination, a slidably mounted rod telescoped in a base post, a horizontally-extending platform attached to said rod, and a punching bag suspended from said platform. In U.S. Pat. No. 4,257,589 to Outlaw there is disclosed a handle and cleat adjustment structure for vertical adjustment of a suspended training device. Furthermore, none of the punching bag supports of the prior art, except for the Schindler invention, permit a bag to be punched while moving laterally. Generally, the adjustable punching bags of the prior art also change the bag's reflex time when the tethered supporting rope or rod is adjusted to various lengths. These and other limitations of the prior art are overcome by the invention of the present disclosure.

SUMMARY OF THE INVENTION

The present invention is a tethered punching bag support device generally comprising a structural framework including a lower frame assembly, a laterally adjustable upper frame assembly, a height adjustment pole assembly disposed between the lower frame assembly and the upper frame assembly, a punching bag support platform attached to the upper frame assembly, and a laterally adjustable cross bar selectively attachable to either the lower frame assembly or the height adjustment pole assembly. A tethered punching bag is adjustably extendable at various lengths from the punching bag support platform. Support platform may be disposed at various angular orientations from the upper frame assembly.

An object of the present invention is to provide a tethered punching bag support that is adjustable for training in the various boxing regimens including speed punching, jabs, hooks, power punching and lateral movement.

Another object of the present invention to provide a punching bag support that can be adjusted vertically for training of boxers of different height or for training for opponents of different height.

It is also an object of this invention to provide a punching bag support that can be vertically adjusted without changing the reflex time of the punching bag.

A further object of the present invention is to provide a boxing training device that can be easily assembled and disassembled for storage and transport.

These and other objects and advantages of the present invention will be apparent to those skilled in the art from the following description of a preferred embodiment, claims and accompanying drawings.

DESCRIPTION OF A PREFERRED EMBODIMENT

Figure 1:
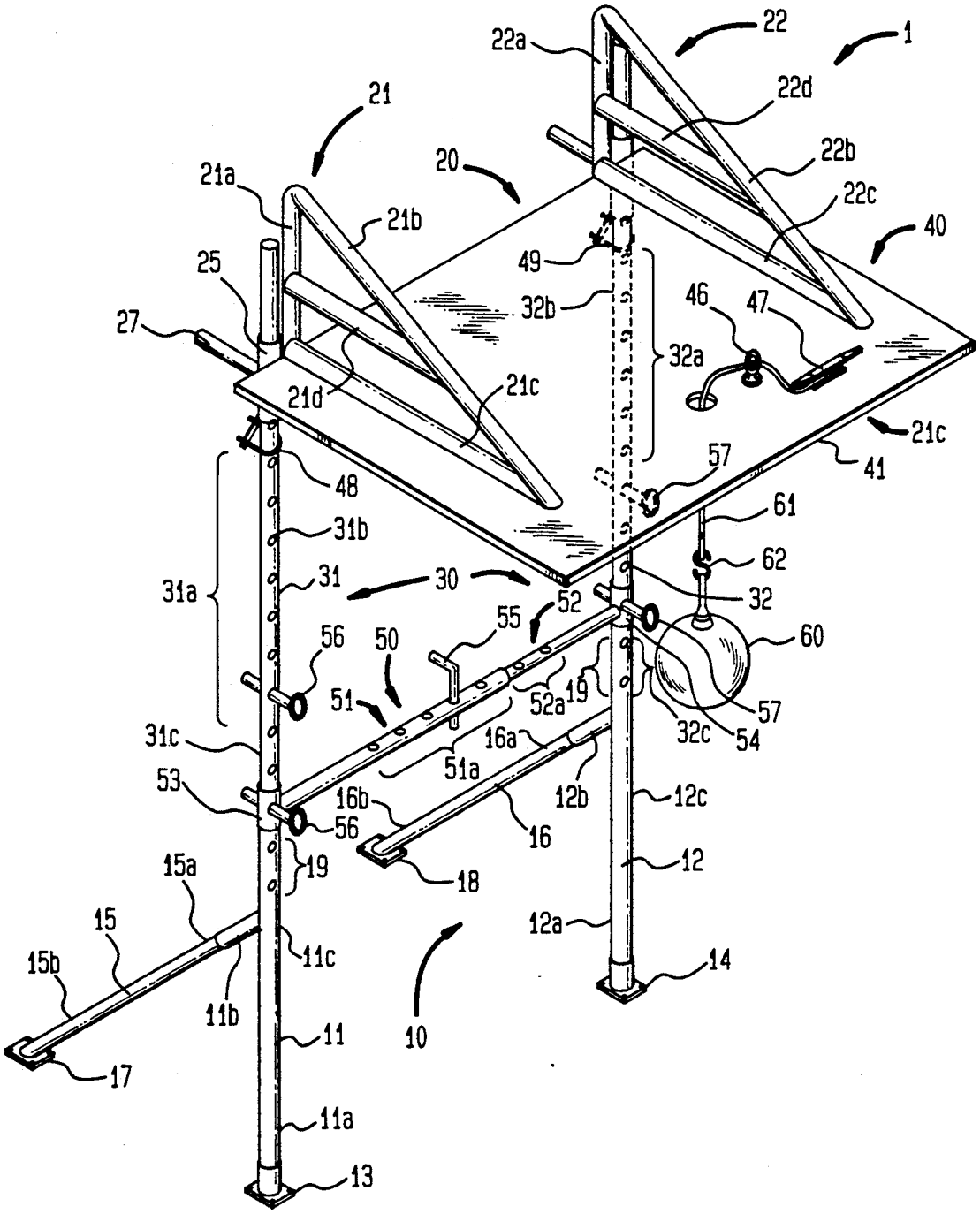
FIG. 1 is a front perspective view of the punching bag support device of the present invention.

FIG. 1 illustrates in a front perspective view a preferred embodiment of the tethered punching bag support device 1 of the present invention. Punching bag support device 1 generally comprises a lower frame assembly 10, an upper frame assembly 20, a height adjustment pole assembly 30 disposed between the lower frame assembly 10 and the upper frame assembly 20, a punching bag support platform 40 adjustably attached to the upper frame assembly 20, and a laterally adjustable cross bar 50 selectively attachable to either the lower frame assembly 10 or the height adjustment pole assembly 30 as hereinafter described in greater detail.

Lower frame assembly 10 includes respective first and second vertically-extending base post members 11 and 12, preferably tubular members. Respective base post footings 13, 14 selectively engage the lower ends 11a, 12a of the base post members 11, 12. Base post members 11, 12 further include respective brace engagement arms 11b, 12b which are fixedly attached to an upper portion of said base post members 11, 12 at a rearwardly and downwardly-extending angular orientation of approximately 45°.Said brace engagement arms 11b, 12b selectively receive the upper ends 15a, 16a of respective lower frame assembly brace members 15, 16. Brace member footings 17, 18 selectively engage the lower ends 15b, 16b of the respective brace members 15, 16. A plurality of vertically displaced base post openings 19 extend laterally through the upper ends 11c, 12c of the respective base post members 11, 12 for selective vertical adjustment of the height adjustment pole assembly 30 and the cross bar 50 as hereinafter described in greater detail.

Figure 2:
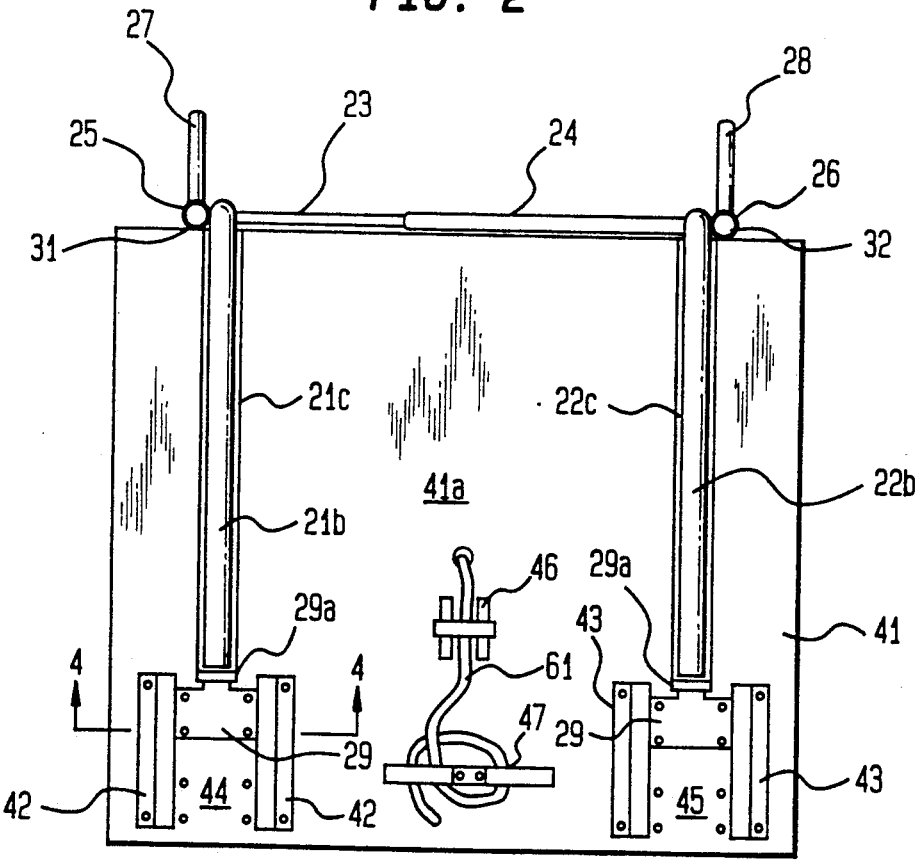
FIG. 2 is a top plan view of the upper frame assembly.

Upper frame assembly 20 includes first and second right-triangled frame subassemblies 21, 22 having the right angle of said frame subassemblies 21, 22 disposed to the rear of said upper frame assembly 20. The respective first and second frame subassemblies 21, 22 preferably comprise a vertical tubular member 21a, 22a, a hypotenuse tubular member 21b, 22b and a base member 21c, 22c preferably formed from a T-shaped beam having the stem 21c', 22c'thereof (FIG. 4) extending vertically upward. Subassembly stiffeners 21d, 22d extend between the vertical tubular members 21a, 22a and the hypotenuse tubular member 21b, 22b parallel to the base members 21c, 22c. Respective first and second lateral arms 23, 24 are fixedly attached at one end to inside portions of the respective vertical tubular members 21a, 22a, the distal end of the first lateral arm 23 being telescopically received in the distal end of the second lateral arm 24 (FIG. 2). Height adjustment pole receptacles 25, 26 are fixedly attached to outside portions of the respective vertical tubular members 21a, 22a. Respective pull-up bars 27, 28 extend rearwardly from the respective pole receptacles 25, 26.

As can be seen in the top plan view of the upper frame assembly 20 in FIG. 2, a hinge plate 29 is hingedly attached by hinge means 29a to the forward end of the respective base members 21c, 22c. Hinge plate 29 facilitates the angular adjustment of punching bag support platform 40 as hereinafter described.

Referring again to FIG. 1 it can be seen that height adjustment pole assembly 30 substantially comprises first and second height adjustment poles 31 and 32. Each of the poles 31, 32 includes a plurality of vertically displaced pole openings 31a, 32a which extend laterally through the poles 31, 32. Height adjustment poles 31, 32 are selectively receivable at upper ends thereof 31b, 32b in the height adjustment pole receptacles 25, 26 of the upper frame assembly 20. The respective lower ends 31c, 32c of the respective poles 31, 32 are selectively receivable in the upper ends 11c, 12c of the respective base post members 11, 12. Height adjustment poles 31, 32 can therefore be vertically adjusted within the base post members 11, 12. Upper frame assembly 20 can be separately adjusted vertically along the length of the height adjustment poles 31, 32.

Figure 3:
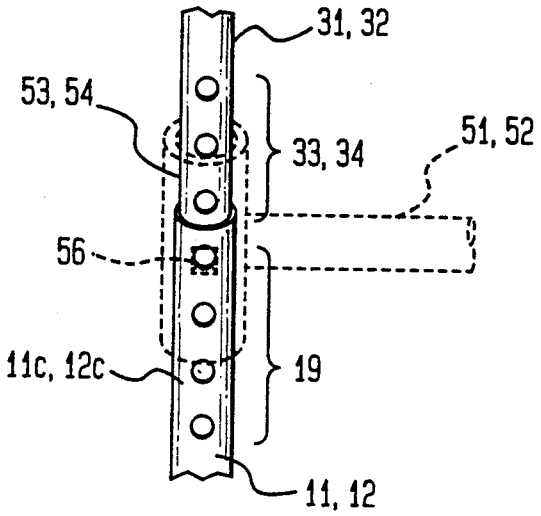
FIG. 3 is a fragmented elevational view of a juncture of the lower frame assembly and the height adjustment pole assembly.

Cross bar 50 comprises first and second bar members 51, 52 telescopically receivable in each other and having respective vertically disposed cross bar end members 53, 54 fixedly attached at respective ends of the respective bar members 51, 52. The respective first and second bar members 51, 52 include respective bar member openings 51a, 52a which selectively align for fixed attachment of the bar members 51, 52 via a cross bar pin 55. As can be seen in the fragmented elevational view of the juncture illustrated in FIG. 3 the cross bar end members 53, 54 surround the base post members 11, 12 and the height adjustment poles 31, 32. Height adjustment poles 31, 32 and cross bar 50 are selectively fixable to base post members 11, 12 by engagement of respective vertical adjustment pin 56, 57 in the base post openings 19 and the pole openings 31a, 32a.

Figure 4:
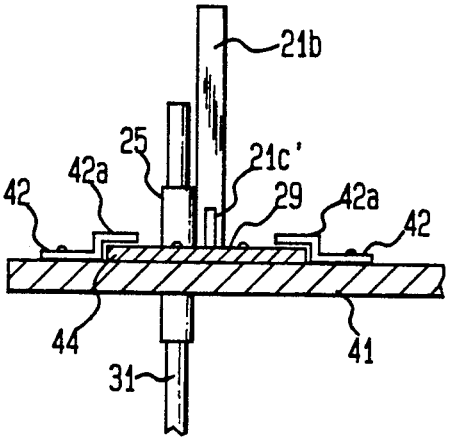
FIG. 4 is a cross-sectional view of a portion of the upper frame assembly taken along line 4—4 of FIG. 2.

Punching bag support platform 40 generally comprises a substantially flat board 41, preferably formed from plywood or like laminated wooden structure. As can be seen in FIG. 2, support platform 40 further includes respective pairs of Z-shaped angle members 42, 43 disposed to each side of the hinge plates 29. The upper legs 42a, 43a of the angle members 42, 43 are disposed above the outer portions of the hinge plates 29 to thereby provide respective retaining guide slots 44, 45 for the hinge plates 29 (FIG. 4). Hinge plates 29 are slidable within the retaining guide slots 44, 45 to move forwardly and rearwardly therein for angular adjustment of board 41. Support platform 40 further includes a rope pulley 46 and rope anchor 47 for adjustable attachment of a punching bag 60. Punching bag 60 is attached to a rope 61 via a S-hook 62 and is selectively extendable at various distances from board 41. Rope 61 extends through board 41 around rope pulley 46 and is fastenable around rope anchor 47 to secure the punching bag 60 at a selected height.

Figure 5:
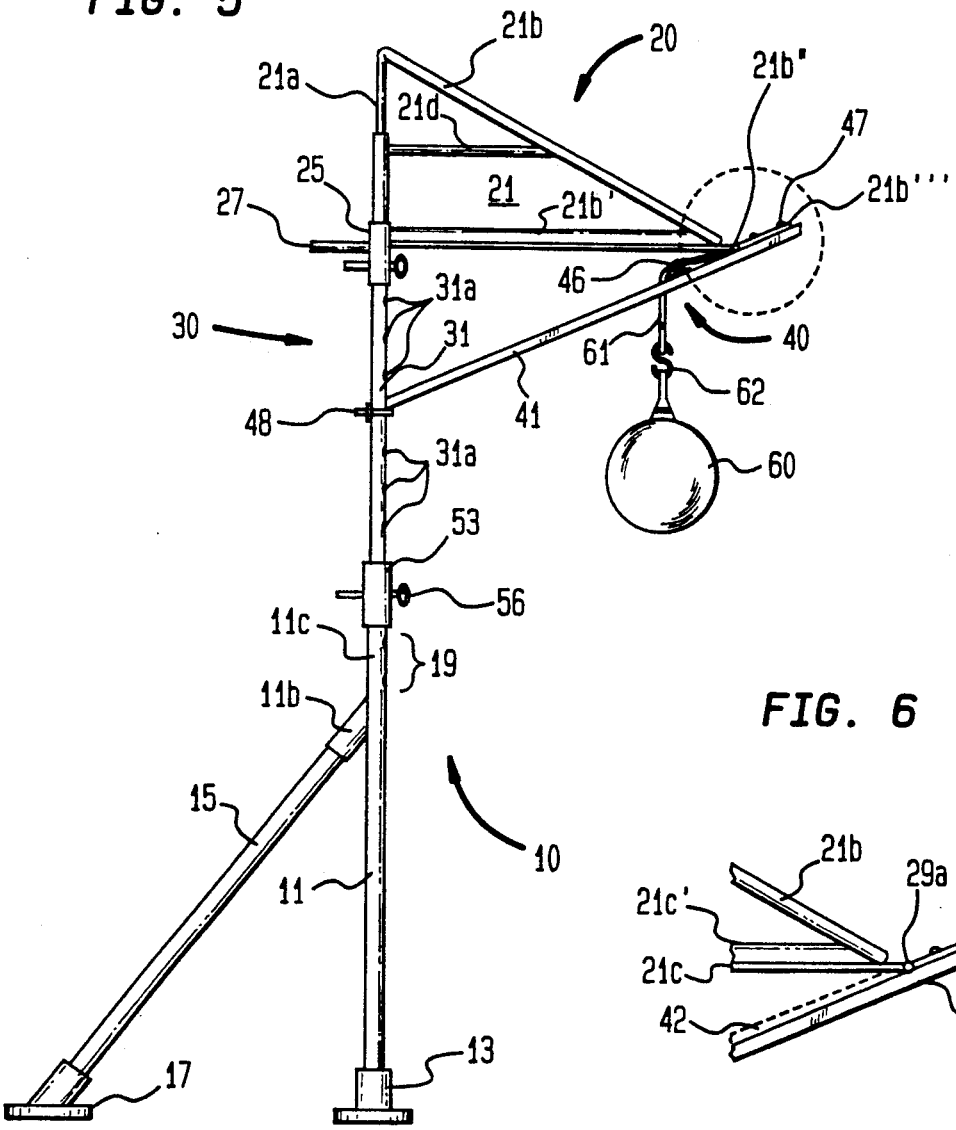
FIG. 5 is a side elevational view of the support device shown with the punching bag support platform disposed at an angular orientation from the upper frame assembly.
Figure 6:
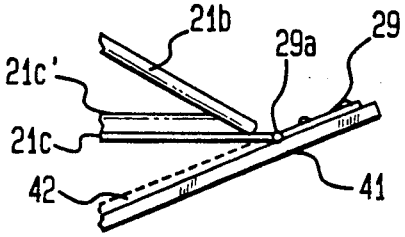
FIG. 6 is an enlarged side elevational view of the encircled portion of FIG. 5.
Figure 7:
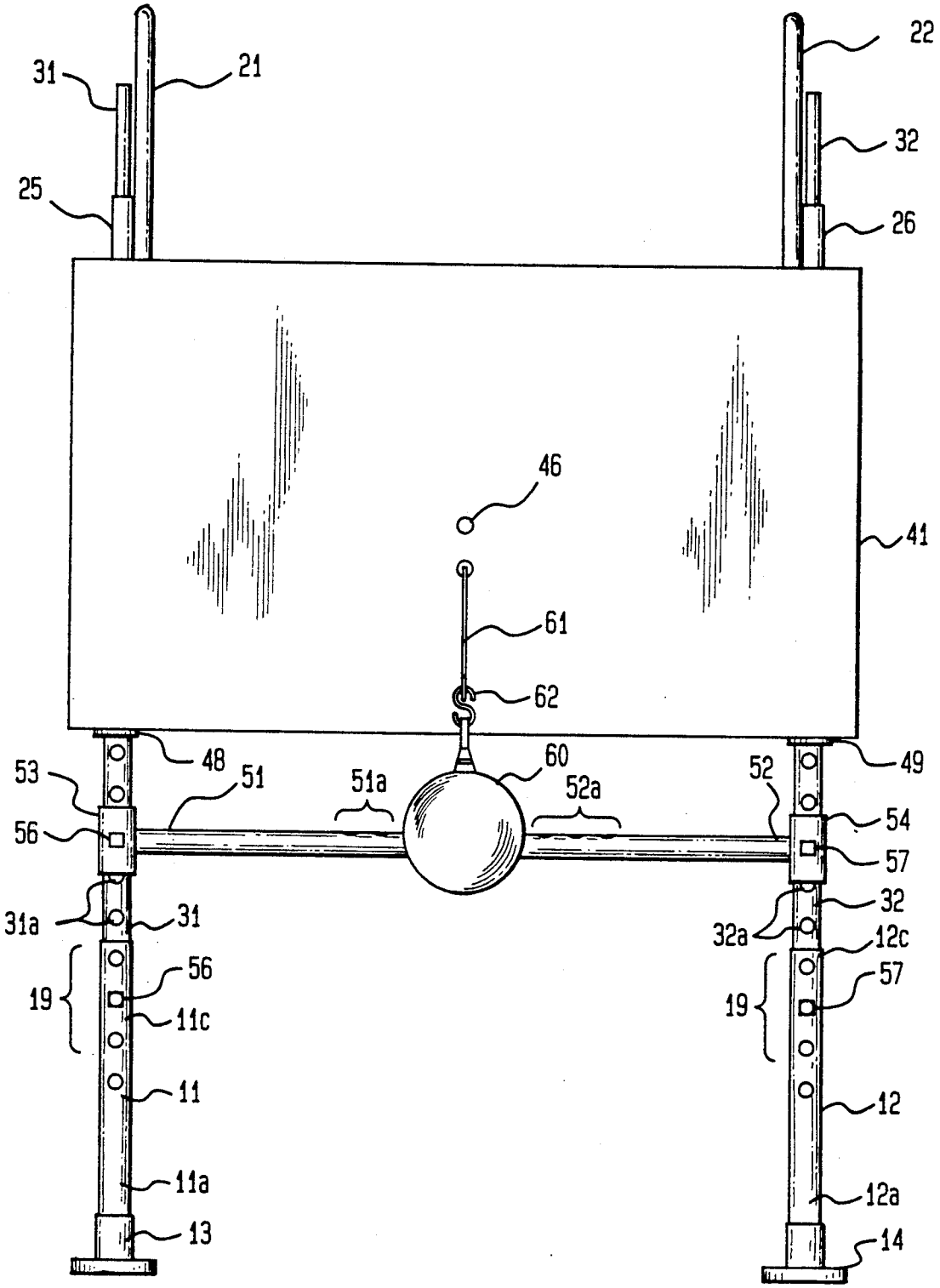
FIG. 7 is a front elevational view of the support device of the present invention showing an alternative vertical positioning of the cross bar.

Board 41 can be adjusted to various angular orientations relative to upper frame assembly 20. When board 41 is disposed in a first horizontal position as illustrated in FIGS. 1 and 2, hinge plates 29 are fixedly attached to a first position on the upper surface 41a of board 41 below a rearward portion of the respective pairs of Z-shaped angle members 42, 43 (FIG. 2). The rearward edge of board 41 is disposed on U-clamps 48, 49 fixedly attached to the respective pole receptacles 25, 26 of upper frame assembly 20. To disposed board 41 in a second position as illustrated in FIGS. 5 and 7, hinge plates 29 are moved forward below the Z-shaped angle members 42, 43 and fixedly attached to a more forward portion of board 41 (FIG. 6). The rearward edge of board 41 is simultaneously lowered and disposed on U-clamps 48, 49 now attached to the respective height adjustment poles 31, 32.

As shown in the front elevational view of the punching bag support device 1 illustrated in FIG. 7, cross bar 50 may alternately be disposed between and attached to the respective height adjustment poles 31, 32.

Various changes, modifications and additions may be made to the present invention without departing from the spirit and scope of this disclosure. Such changes, modifications and additions within a fair reading of the claims are considered a part of the present invention.

Therefore, in view of the foregoing, I claim:

1. A tethered punching bag support device comprising:

a lower frame assembly an upper frame assembly selectively attachable to an upper portion of said lower framer assembly, said upper frame assembly having a plurality of subassemblies wherein each subassembly includes a base member, a height adjustment pole assembly selectively disposable between said lower frame assembly and said upper frame assembly, a punching bag support platform further including a substantially flat board selectively attachable to said upper frame assembly, a plurality of Z-shaped angle members disposed in displaced relationship on a bottom surface of said flat board and fixedly attached thereto, hinge means pivotally attached at forward ends of said base members, said respective hinges having side portions thereof disposed below said Z-shaped angle member in sliding engagement there with, said hinges being selectively attachable to said board, a plurality of clamp members selectively attachable to respective height adjustment poles thereby providing board retaining means for variable angular adjustment of said board and said support platform, relative to said upper frame assembly and, a punching bag being adjustably attachable to said support platform.

2. A tethered punching bag support device as in claim 1 wherein said height adjustment pole assembly comprises respective first and second height adjustment poles selectively receivable at an upper end in the upper frame assembly and selectively receivable at a lower end in the lower frame assembly, said respective height adjustment poles including a plurality of vertically displaced pole openings which selectively align with the plurality of vertically displaced base post openings.

3. A tethered punching bag support device as in claim 2 wherein said upper frame assembly includes first retention means to selectively retain said upper frame assembly in a fixed position on the respective height adjustment poles, and said respective height adjustment poles include second retention means to selectively retain said poles in a fixed position in the lower frame assembly.

4. A tethered punching bag support device as in claim 3 wherein said upper frame assembly comprises respective first and second right-triangled frame subassemblies having the right angles thereof disposed to the rear of said upper frame assembly, said respective frame subassemblies including a vertical member, a hypotenuse member, said respective frame subreassemblies further including first and second lateral arms fixedly attached at one end to inside portions of the respective vertical members, the opposite ends thereof being telescopically connected, said respective frame subassemblies further including first and second height adjustment pole receptacles fixedly attached to outside portions of the respective vertical members, said height adjustment poles being slidably receivable in said pole receptacles and selectively retainable in a fixed engagement therein.

5. A tethered punching bag support device as in claim 4 further including respective first and second subassembly stiffeners fixedly attached in parallel alignment with the base member between the vertical member and the hypotenuse member.

6. A tethered punching bag support device as in claim 5 wherein said base member is formed from a T-shaped beam having the stem thereof extending vertically upward.

7. A tethered punching bag support device as in claim 6 further including respective first and second pull up bars fixedly attached to said respective height adjustment pole receptacles.

8. A tethered punching bag support device as in claim 7 wherein said punching bag support platform further including respective pairs of Z-shaped angle members disposed in displaced relationship on a top surface of said board and fixedly attached thereto, said support platform further includes a rope pulley and a rope anchor disposed on said top surface of said board.

9. A tethered punching bag support device as in claim 8 wherein the respective base members of said frame subassemblies further includes respective hinges pivotally attached at forward ends of said base members, said respective hinges having side portions thereof disposed below said Z-shaped angle members in sliding engagement therewith, said hinges being selectively attachable to said board, said punching bag is selectively attachable to a rope communicating with said rope anchor via said rope pulley.

10. A tethered punching bag support device as in claim 9 further including a cross bar comprising first and second bar members selectively and adjustably telescopically connected, said respective bar members having respective cross bar end members fixedly attached to respective distal ends of said bar members, said respective end members being selectively attachable to the respective height adjustment poles or said base post members.

11. A tethered punching bag support device as in claim 10 where said clamp members are U-clamps of said board said respective height adjustment poles of said pole receptacles thereby providing board retaining means for variable angular adjustment of said board.

12. A tethered punching bag support device as in claim 10 further including a punching bag selectively attachable to a rope, said rope being selectively attachable to said rope anchor via said rope pulley.

* * * * *